US005810312A

United States Patent [19]

Perlman

[11] Patent Number: 5,810,312

[45] Date of Patent: Sep. 22, 1998

[54] ADHESIVE SUPPORT ASSEMBLY WITH HEAT-MELTABLE ADHESIVE

[75] Inventor: Daniel Perlman, Arlington, Mass.

[73] Assignee: Brandeis University, Waltham, Mass.

[21] Appl. No.: 597,287

[22] Filed: Feb. 6, 1996

[51] Int. Cl.[6] ..... A47B 91/00

[52] U.S. Cl. ..... 248/346.01; 43/114

[58] Field of Search ..... 248/346.01; 43/114, 43/136

[56] References Cited

U.S. PATENT DOCUMENTS

| | | | |
|---|---|---|---|
| 4,599,822 | 7/1986 | Baker | 73/114 |
| 4,748,125 | 5/1988 | Pizzolante . | |
| 5,577,342 | 11/1996 | Johnson et al. | 73/114 |

FOREIGN PATENT DOCUMENTS 2026902 7/1979 United Kingdom .

OTHER PUBLICATIONS

Ames, "Polyolefin Containing Hot–Melt Adhesive Short Set Time and Both Good Low and High Temperature Bond Strength Properties," U.S. Patent No. 4,567,223, *Offificial Gazette of the United States Patent and Trademark Office,* Jan. 28, 1986, 1986, p. 1635 (Abstract).

Foster et al., "Hot–Melt Adhesive Composition," U.S. Patent No. 4,886,853, *Officianl Gazette of the United States Patent and Trademark Office,* Dec. 12, 1989, p. 881 (Abstract).

McConnell et al., "Blends of Substantially Amorphous Higher 1–Olefin Copolymers and Tackifying Resins Useful as Pressure Sensitive Adhesives," U.S. Patent No. 4,217, 428, *Official Gazette of the United States Patent and Trademark Office,* Aug. 12, 1980 p. 668, p. 1635 (Abstract).

McConnell et al., "Poly (Higher–1–Olefin–Co–Propylene) Copolymers as Hot–Melt, Pressure–Sensitive Adhesives," U.S. Patent No. 3,954,697, *Official Gazette of the United States Patent and Trademark Office,* May 4, 1976, p. 266 (Abstract).

Popat et al, "Pressure Sensitive Label Assembly," U.S. Patent No. 5,262,216, *Official Gazette of the United States Patent and Trademark Office,* Nov. 16, 1993, p. 1718 (Abstract).

*Propylene–Hexene Copolymers From Eastman Chemical Company,* Eastman Chemical Company, Texas Eastman Division, Longview, Texas.

Stuart et al., "Adhesive copolymer of propylene and hexene and absorbent articles utilizing it," PCT/WO 89 01,002, *Chemical Abstracts* 110:193959r (1989) (Abstract).

Trotter et al., "Propylene/1–Butene or 1–Pentene/Higher 1–Olefin Copolymers Useful as Pressure–Sensitive Hot–Melt Adhesives," U.S. Patent No. 4,259,470, *Official Gazette of the United States Patent and Trademark Office,* Mar. 31, 1981, p. 2090 (Abstract).

Trotter et al., "Blends of Propylene/1–Butene or 1–Pentene/Higher α–Olefin Copolymers, Compatible Tackifying Resins and Plasticizing Oils Useful as Hot–Melt Pressure–Sensitive Adhesives," U.S. Patent No. 4,288,358, *Official Gazette of the United States Patent and Trademark Office,* Sep. 8, 1981, p. 2090 (Abstract).

*Primary Examiner*—Ramon O. Ramirez
*Assistant Examiner*—Willie Berry, Jr.
*Attorney, Agent, or Firm*—Lyon & Lyon LLP

[57] ABSTRACT

An adhesive support assembly for attaching at least one article. The support assembly includes a bed of pressure-sensitive adhesive having an upper surface. The adhesive bed which is also heat-meltable, is held within a tray or other walled container. This container is sufficiently heat-resistant to allow heating the support assembly to at least the ring and ball softening temperature of the adhesive so that when the upper surface of the adhesive bed has become shopworn or loses adhesive strength from repeated use and/or adhesion of dirt, the assembly can be heated to at least this softening temperature to restore this adhesive strength.

22 Claims, 2 Drawing Sheets

ADHESIVE SUPPORT ASSEMBLY WITH HEAT-MELTABLE ADHESIVE

BACKGROUND OF THE INVENTION

This invention relates to movable adhesive support assemblies for workpieces and other articles, and the composition and design of these assemblies which, in conjunction with their usage and care, extend the lifetime of the adhesive and thereby improve the economy and convenience of the support assemblies.

A wide variety of racks, holders, supports, trays, carriers, and stands are used to store, immobilize, and hold articles upright in the technical workplace such as the scientific laboratory. In the course of many technical procedures requiring visual monitoring of articles such as laboratory vessels, it can be useful to support these articles at their base rather than along their sides to provide maximum visual access to the articles. Accordingly, it may be preferable to use a horizontal adhesive platform rather than a test tube rack having vertical holes to hold a tall sample vial. For articles which are either free-standing but somewhat unstable even on a flat surface, e.g., vials and optical cuvettes, or for articles which are non-free-standing such as round-bottomed test-tubes, conical-bottomed microcentrifuge tubes, and irregularly-shaped articles, the use of an adhesive workpiece platform (hereinafter more generally termed an adhesive support assembly) can be particularly valuable. It is important that the adhesive surface on such support assemblies used for holding and supporting articles having non-planar or irregularly shaped base surfaces have a degree of compliancy to conform to the bottom of such articles.

Pizzolante, U.S. Pat. No. 4,748,125 describes an adhesive test tube rack having at least one adhesive-bearing test tube supporting member connected to a base member. The patented rack is configured to support test tubes in a non-free-standing manner. In U.K. Pat. Applic. No. 2,026,902 A, Seltenheim et al. describe the use of a moderately thick (preferably between 0.5 and 2.0 mm thick) adhesive support surface for articles. Workpieces such as a beaker with a curved base were more readily embedded in a moderately thick, rather than a thin adhesive layer. The thick adhesive layer provided a means "whereby articles can be releasably secured to a supporting surface by means of an adhesive coating or layer without the same losing its adhesive power even if the articles are removed frequently and even if the layer becomes relative dirty" (lines 24–28, p.1). The only type of adhesive system referred to by Seltenheim et al. is a two component polyurethane-based material which was subjected to a drying or curing process on the side intended to receive the workpieces, and "the adhesive material constituents responsible for the tackiness or adhesion of the adhesive layer migrate during the drying process from the side being dried to the opposite side . . . " (lines 53–57, p.2). Applicant has observed that although dirt which contacts a thick adhesive layer may become partially submerged in that adhesive, the exposed adhesive surface is not freely exchangeable with the underlying adhesive. If heated, such polyurethane adhesives eventually char and burn but will not melt. With repeated use, the adhesive strength of the polyurethane support surface diminishes with time, and the adhesive must be replaced. This latter fact is acknowledged by Seltenheim et al. in the description of methods used to release the adhesive layer prior to its replacement (lines 66–87, p.2).

SUMMARY OF THE INVENTION

This invention concerns the composition, configuration and use of a portable adhesive support assembly for attaching articles such as laboratory sample vessels. Fabricated as described herein, utilizing a pressure-sensitive heat-meltable adhesive contained within a heat-resistant tray, when the surface of an adhesive bed has become shopworn or lost adhesive strength from repeated use and/or accumulated dirt, the adhesive can be heated to its softening or melting temperature to smooth its surface and remove (i.e., submerge) the surface dirt thereby restoring the adhesive strength of the bed. In this manner the support assembly may be used indefinitely without replacing the adhesive, thereby providing economy and convenience. The ability to rejuvenate the adhesive of the present invention rather than discarding and replacing it when it loses adhesive strength, overcomes significant shortcomings of the adhesive systems of Seltenheim et al., and the disposable adhesive test tube rack of Pizzolante. The preferred use of at least one amorphous polyolefin (hereinafter abbreviated APO) as an adhesive in the support assembly, provides additional benefits for some of the intended applications of the present invention. In particular, the APO adhesives as polyolefins, are substantially resistant to organic solvents and caustic agents so that they are usually resistant to damage when contacted by laboratory chemicals which are often carried in sample vessels attached to the support assembly.

Thus, in a first aspect, the invention features an adhesive support assembly for attaching one or more articles. The support assembly includes a bed of pressure-sensitive adhesive contained within a tray or other walled container. The adhesive is heat-meltable (i.e. can be caused to liquify e.g., at temperatures above about 80°–100° C., and preferably at a higher temperature), and the container is sufficiently heat-resistant to allow heating the entire assembly to at least the ring and ball softening temperature of the adhesive. Thus, when the upper surface of the adhesive bed has become shopworn or lost adhesive strength from repeated use and/or adhesion of dirt and has become less useful, the assembly can be heated to at least the above softening temperature to restore its adhesive strength.

In preferred embodiments, the bed of pressure-sensitive adhesive has a substantially flat upper surface which supports and immobilizes the attached article. The adhesive bed also has a lower surface which is in adhesive contact with the inside surface of the tray or other walled container. The nature of the pressure-sensitive adhesive in the support assembly permits an article, once attached to the upper surface of adhesive, to be detached from this upper surface without the adhesive leaving an adhesive residue on the article, while the lower surface of the adhesive bed remains in adhesive contact with the inside surface of the tray or other walled container. The adhesive support assembly may further include a peelable release paper liner covering and protecting the upper surface of the adhesive, the liner being configured and arranged to facilitate its peeling from the adhesive prior to using the support assembly. In addition, the adhesive support assembly is preferably portable. Because the adhesive bed is sufficiently compliant and adhesive, articles which can be attached to the support assembly include both free-standing laboratory vessels such as flat-bottomed beakers and flasks, and non-free-standing vessels such as round-bottomed test tubes and conical-bottomed microcentrifuge tubes. Laboratory vessels suitable for being supported by and attached to the support assembly include test tubes, centrifuge tubes, microtubes, specimen vials, freezer vials, optical cuvettes, laboratory flasks, tissue culture flasks, laboratory beakers, and graduated cylinders. The support assembly includes an adhesive bed which is compliant so as to enhance the support and immobilization of upright articles.

In yet other preferred embodiments, the tray or other walled container component of the support assembly is sufficiently heat-resistant to allow heating the assembly to at least the melting temperature of the adhesive. Preferably, the adhesive support assembly can be heated to a temperature of between approximately 120° C. and 200° C. after repeated use and/or adhesion of dirt to restore adhesive strength to the upper surface of the adhesive bed. The thickness of the adhesive bed is greater than 2 mm, and preferably between approximately 2 mm and 20 mm thick. Additionally, it is preferred that the pressure-sensitive adhesive provide useful adhesion for attaching articles within the temperature range of between approximately −20° C. to +100° C., or at least within a temperature range of between approximately 0° C. and 80° C. For use in chemical laboratories and other challenging environments, it is also preferred that the pressure-sensitive adhesive be resistant to organic solvents and caustic agents. Accordingly, for such resistance the pressure-sensitive heat-meltable adhesive is an amorphous polyolefin. This amorphous polyolefin is preferably selected from the group which includes amorphous propylene-hexene copolymers, amorphous propylene-ethylene copolymers and amorphous terpolymers. Most preferably, the pressure-sensitive adhesive is a propylene-hexene amorphous polyolefin copolymer which tends to be very sticky. For containment of the adhesive, the support assembly includes a tray or other walled container fabricated from a heat-resistant material selected from the group including metal, glass, and heat-resistant thermoplastic resin. This tray or container is preferably fabricated from a heat-resistant thermoplastic resin selected from the group including crystalline polyethylene terephthalate and polyester copolymers. It is also preferred that the adhesive support assembly can be autoclaved or dry-heat sterilized to allow later use of the sterilized assembly in supporting and immobilizing sterile articles.

The adhesive support assembly of the present invention provides an improved adhesive bed for attaching and supporting articles, the improvement residing in the characteristics of the adhesive used to form the bed, and the container used to hold the adhesive. The adhesive is one such as an amorphous propylene-hexene copolymer which is meltable at an elevated temperature while being pressure-sensitive at ambient temperature. A tray or other open container which can withstand the elevated temperature used to soften or melt the adhesive is selected, and is a part of the support assembly. The ability to rejuvenate and reuse the adhesive surface(s) of the support assembly by heating the assembly when its surface loses adhesive strength from repeated use and adhesion of dirt, distinguishes the present invention from prior art adhesive supports such as that of Seltenheim et al. The system of Seltenheim et al. provides a moderately thick layer (up to 2 mm) of a standard dried adhesive, which can absorb some surface dirt to extend the life of the adhesive. However, the present invention provides an adhesive support bed which is meltable, allowing adhered surface dirt to be fully submerged in the adhesive bed and preferably sink to the bottom of the bed when melted, where the dirt can not interfere with surface adhesion. Applicant has found that with a meltable bed of adhesive which is approximately 2 mm thick or thicker, the bed can be softened and/or re-melted an indefinite number of times to restore the pressure-sensitive adhesive property of the bed's surface. Additionally, a thickness of adhesive which exceeds 2 mm is preferred because it allows non-free-standing articles such as conical-bottomed centrifuge tubes to be pushed down into the adhesive to a depth sufficient to improve the support of these articles, e.g., 1–2 mm. This improved support either prevents the unstable article from falling over, or at least substantially extends the time before the article tilts over onto its side. After pushing many articles into the supporting adhesive over a period of time, and creating blemishes and craters in the adhesive, the ability to occasionally smooth the surface by heating and softening the adhesive is desirable, if not essential to the long lifetime of the present invention.

A number of heat-meltable pressure-sensitive adhesives are commercially available and may be utilized in this invention. The amorphous polyolefins are particularly versatile and useful in the scientific laboratory and in other challenging environments. They are inexpensive, durable, non-toxic and non-irritating to the skin, resistant to most chemicals including most organic solvents and caustic agents, resistant to UV light, remain strongly adhesive over an extended temperature range and yet are cleanly peelable from most articles without leaving an adhesive residue. Also because they soften and melt at temperatures under 200° C., it is relatively easy to cast or extrude these adhesives. The amorphous propylene-hexene copolymer polyolefins currently known as D-174, D-127 and D161 pressure-sensitive APHs as manufactured by the Eastman Chemical Company (Texas Eastman Division, Longview, Tex.) are particularly well suited for use in the present invention and exhibit adhesive properties below, at, and above room temperature, i.e., from approximately −20° to +100° C. The D-174 and D-127 APHs are more tacky and adhesive than D-161, and are particularly useful at low temperatures (near or below freezing) where initial adhesive tack is diminished, or under conditions where high adhesive strength is preferable. On the other hand, for ambient or higher temperature uses where the adhesive strength of all three APHs is adequate, D-161 may be preferred, especially if easy release of the secured article is desirable. With laboratory uses, Applicant has found that glass articles are particularly tightly held by the APHs. Typically, a twist and pull has been found to release a secured article from the adhesive bed. With the amorphous polyolefin adhesives, the article (glass, metal or plastic) is generally released without any residue of adhesive remaining on the article.

A number of heat-resistant materials are suitable for fabricating containers to hold the above adhesives. In addition to metal and glass materials which are currently used in the manufacture of laboratory trays, e.g., stainless steel, aluminum and heat-resistant glass (such as Pyrex®-brand glass), Applicant has tested several cost-effective plastic trays and found them to be very useful in the present invention. Two of these which are presently used in fabricating "heat and serve" oven trays include polyesters known as crystalline polyethylene terephthalates (abbreviated commercially as CPET). Two of these polyesters manufactured by the Eastman Chemical Company (Kingsport,Tenn.) are known as Tenite polyesters 15041 and 12822 and are converted to the heat-resistant crystalline form during thermoforming sheet stock material. An additional polyester material known as Thermx copolyester 6761 (also made by the Eastman Chemical Company) is even more resistant to elevated temperatures. Trays fabricated from these plastic resins can withstand sustained temperatures of 190° C. or 375° F. The wholesale commercial price of typical trays [e.g., measuring 10×6×1.5 inches (L×W×H)] manufactured using the Eastman resins is as little as twenty to twenty-five cents each. Manufacturing sources for typical CPET trays include the Genpak Corporation (Columbus, Ohio), Mullinix Packages, Inc. (Fort Wayne, Ind.) and Lawson Mardon Thermaplate Corporation (Piscataway, N.J.).

DESCRIPTION OF THE PREFERRED EMBODIMENTS

The drawings will first be briefly described.

DRAWINGS

FIG. 1 a side-sectional view through an adhesive support assembly holding an optical cuvette and a conical-bottomed microcentrifuge tube (pressed into the adhesive bed).

Figure 1:
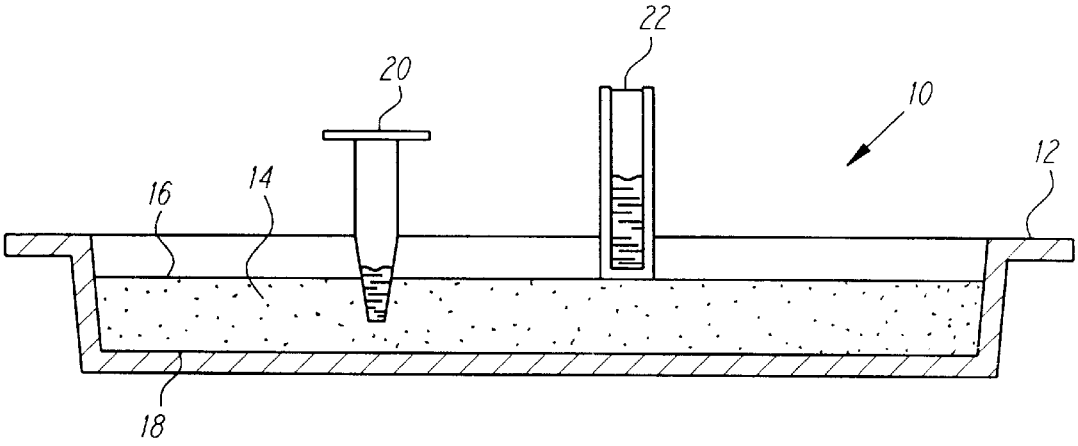
Figure 2:
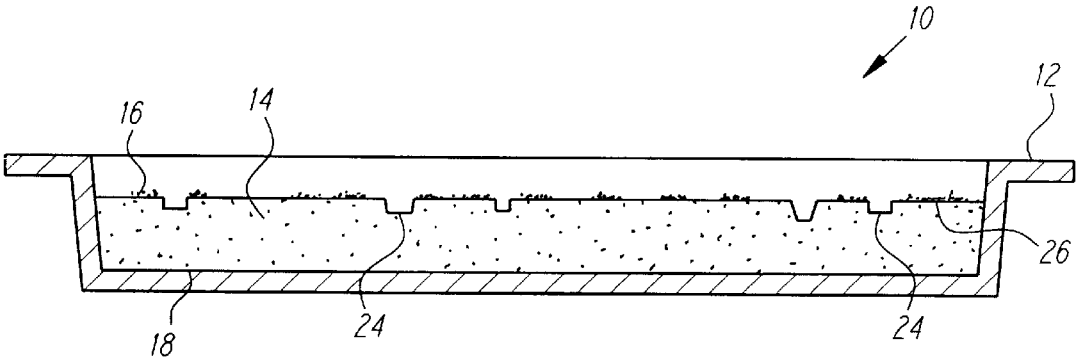
FIG. 2 is a side-sectional view as in FIG. 1 except that the tube and cuvette have been removed, and dirt has accumulated on the adhesive bed to reduce its effectiveness.
Figure 3:
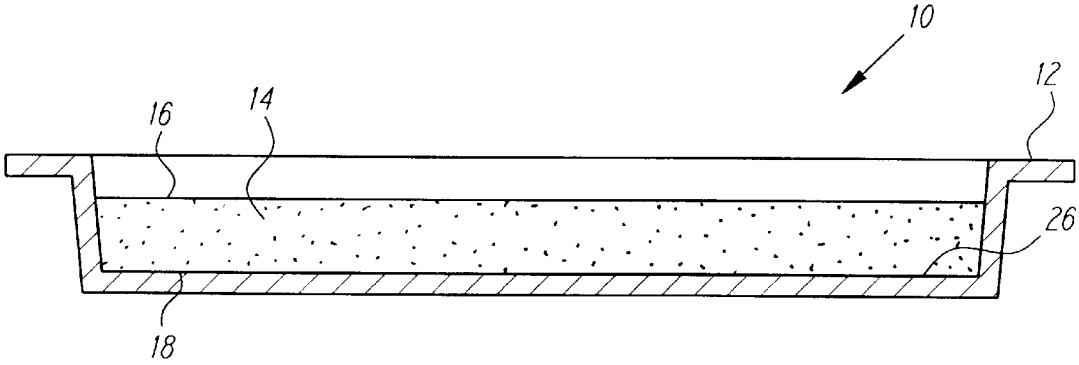
FIG. 3 is a side-sectional view as in FIG. 2 except that the adhesive support assembly has been heated to the melting temperature of the adhesive bed and then cooled.
Figure 4:
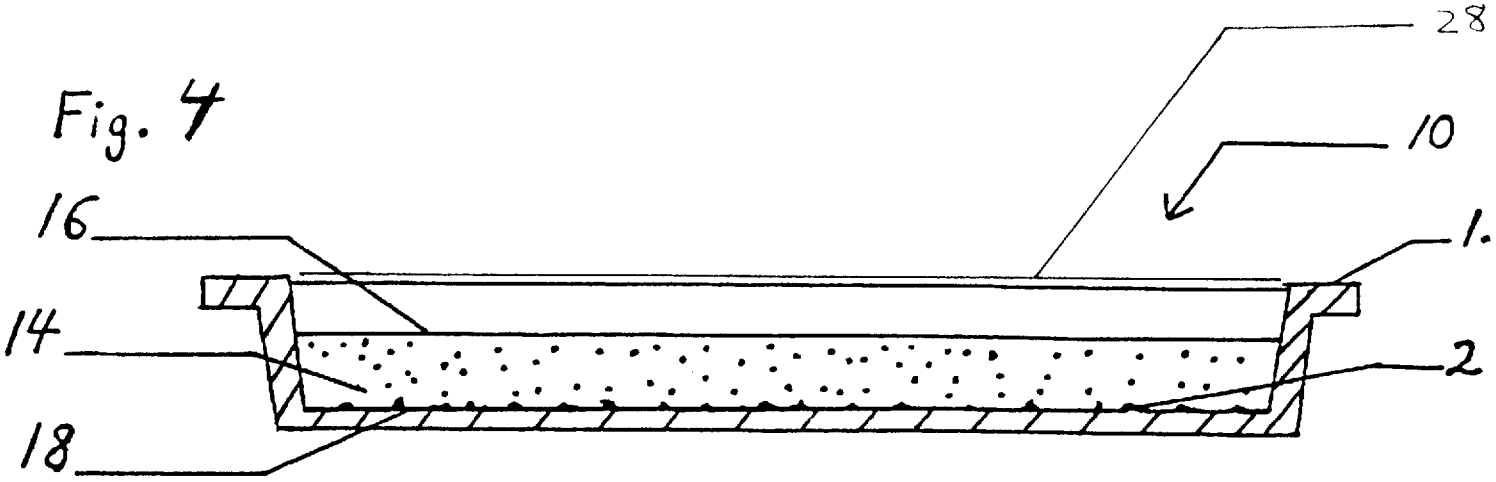
FIG. 4 is a side-sectional view as in FIG. 1, except that no articles are present on the surface, and the surface is covered and protected by a peelable release paper liner.

Referring to the Figures, adhesive support assembly 10 includes a heat-resistant tray 12 measuring approximately 25×15×3 cm (L×W×H) which can be fabricated from a non-breakable thermoplastic polyester such as crystalline polyethylene terephthalate (CPET) serves to hold the heat-meltable pressure-sensitive adhesive material which constitutes adhesive bed 14. Adhesive bed 14 is preferably formed from a chemically resistant pressure-sensitive adhesive such as one or more of the amorphous propylene-hexene copolymers which are members of the larger chemical group known as the amorphous polyolefins. Adhesive bed 14 has an upper surface 16 onto which articles can be secured, and a lower surface 18 which is in adhesive contact with the inside surface of tray 12. The thickness of adhesive bed 14 is preferably between two and twenty millimeters thick. The ring and ball softening temperature of the adhesive material is preferably above 80° but below 200° C. to allow use of the support assembly 10 over a wide temperature range (below and above room temperature), while allowing the re-heating (and softening or melting) of the adhesive bed 14 at a moderate (100° C. or above) household oven temperature. The support assembly 10 can be used to adhesively secure many different articles in the technical workplace such as the scientific laboratory. For example, a non-free-standing microcentrifuge tube 20 is secured and supported within adhesive bed 14, while a free-standing but somewhat unstable optical cuvette 22 is conveniently held on the upper surface 16 of adhesive bed 14. A twist and pull on an article held within, or on adhesive bed 14, serves to release the article. Craters, ridges and other blemishes 24 can persist on the upper surface 16 after releasing articles from adhesive bed 14. Similarly, dirt 26 tends to remain on the upper surface 16, and reduces the adhesive holding power of the support assembly 10. These undesirable features which are illustrated in FIG. 2 can be removed by warming the support assembly to a temperature above the softening temperature of the adhesive, preferably to a temperature above the melting point of the adhesive. The support assembly should be held for a period of time (approximately 30–120 minutes) at this elevated temperature to allow the dirt 26 to submerge in the adhesive bed 14, and the adhesive to flow and form a new smooth upper surface 16 (see FIG. 3). Prior to use, the upper surface of the adhesive bed 14 can be covered and protected by a peelable release paper liner 28 as shown in FIG. 4.

Amorphous polyolefins, particularly the amorphous propylene-hexene copolymers, have been recognized as being useful as hot-melt-pressure-sensitive adhesives.

Manufacture of these copolymers has been previously described in U.S. Pat. Nos. 3,954,697; 4,217,428; 4,259,470; 4,288,358; and 4,567,223. Their potential utility in medical tapes, adhesive tapes, clear sealants, adhesive labels, heat-sealable coatings, laminates, glue sticks, and in product assembly has been mentioned in promotional literature (*Propylene-Hexene Copolymers From Eastman Chemical Company,* Eastman Chemical Company, Texes Eastman division, Longview, Tex.). Applications and formulations for these adhesives used in absorbent pads (Stuart et al., PCT Int. Appl. WO 89 01, 002), in diapers (U.S. Pat. No. 4,886,853), and in adhesive labels (U.S. Pat. No. 5,262,216) have been described.

Other embodiments of the present invention are within the following claims.

I claim:

1. An adhesive support assembly for attaching at least one article, said assembly comprising a bed of pressure-sensitive adhesive, having an upper surface, within a tray or other walled container, wherein said adhesive is heat-meltable at a temperature above about 80° C., and said container is sufficiently heat-resistant to allow heating said assembly to at least the ring and ball softening temperature of said adhesive so that after said upper surface of said bed has become shopworn or lost adhesive strength from repeated use and/or adhesion of dirt, said assembly can be heated to at least said softening temperature to restore said adhesive strength to said upper surface, and wherein the nature of the pressure sensitive adhesive permits said article, once attached to said upper surface, to be detached from said upper surface without said adhesive leaving an adhesive residue on said article.

2. The adhesive support assembly of claim 1 wherein said bed of pressure-sensitive adhesive, having a substantially flat upper surface for supporting and immobilizing said article, also has a lower surface which is in adhesive contact with the inside surface of said tray or other walled container.

3. The adhesive support assembly of claim 1 further comprising a peelable release paper liner covering said upper surface, said liner being configured and arranged to facilitate its peeling from said upper surface prior to using said assembly.

4. The adhesive support assembly of claim 1 wherein said assembly is portable.

5. The adhesive support assembly of claim 1 or claim 2 wherein said article is a free-standing or non-free-standing laboratory vessel.

6. The adhesive support assembly of claim 5 wherein said laboratory vessel is selected from the group consisting of a test tube, centrifuge tube, microtube, specimen vial, freezer vial, optical cuvette, laboratory flask, tissue culture flask, laboratory beaker, and graduated cylinder.

7. The adhesive support assembly of claim 1 wherein said bed is sufficiently compliant to support and immobilize upright articles.

8. The adhesive support assembly of claim 1 wherein said tray or other walled container is sufficiently heat-resistant to allow heating said assembly to at least the melting temperature of said adhesive.

9. The adhesive support assembly of claim 1 or claim 8 wherein said assembly can be heated to a temperature of between approximately 125° C. and 200° C. after said repeated use or adhesion of dirt to restore said adhesive strength.

10. The adhesive support assembly of claim 1 wherein the thickness of said bed is greater than 2 mm.

11. The adhesive support assembly of claim 1 wherein the thickness of said bed is between approximately 2 mm and 20 mm.

12. The adhesive support assembly of claim 1 wherein said pressure-sensitive adhesive provides adhesion for attaching articles within the temperature range of between approximately −20° C. to +100° C.

13. The adhesive support assembly of claim 12 wherein said temperature range is between approximately 0° C. and 80° C.

14. The adhesive support assembly of claim 12 wherein said material is a heat-resistant thermoplastic resin selected from the group consisting of crystalline polyethylene terephthalate and polyester copolymers.

15. The adhesive support assembly of claim 1 wherein said pressure-sensitive adhesive is resistant to organic solvents and caustic agents.

16. The adhesive support assembly of claim 1 wherein said pressure-sensitive adhesive is an amorphous polyolefin.

17. The adhesive support assembly of claim 16 wherein said amorphous polyolefin is selected from the group consisting of amorphous propylene-hexene copolymers, amorphous propylene-ethylene copolymers and amorphous terpolymers.

18. The adhesive support assembly of claim 1 wherein said pressure-sensitive adhesive is a propylene-hexene amorphous polyolefin copolymer.

19. The adhesive support assembly of claim 1 wherein said tray or other walled container is fabricated from a material selected from the group consisting of metal, glass, and heat-resistant thermoplastic resin.

20. The adhesive support assembly of claim 1 wherein said assembly can be autoclaved or dry-heat sterilized to allow the use of said assembly in supporting and immobilizing sterile articles.

21. Method for rejuvenating an adhesive support assembly of claim 1, comprising the step of placing support assembly at a temperature above said softening temperature of said adhesive for a time sufficient to restore adhesive strength to said adhesive upon cooling said adhesive.

22. Method for supporting an article, comprising the steps of providing a support assembly of claim 1, and placing said article onto said adhesive.

* * * * *